United States Patent [19]

Krog

[11] Patent Number: 4,625,861

[45] Date of Patent: Dec. 2, 1986

[54] CASE PREFERABLY FOR A LIGHTER

[76] Inventor: Harald U. G. Krog, 29, Strandparken, Bandholm Maribo 4930, Denmark

[21] Appl. No.: 726,905

[22] PCT Filed: Aug. 16, 1984

[86] PCT No.: PCT/DK84/00076

§ 371 Date: Apr. 17, 1985

§ 102(e) Date: Apr. 17, 1985

[87] PCT Pub. No.: WO85/00872

PCT Pub. Date: Feb. 28, 1985

[30] Foreign Application Priority Data

Aug. 17, 1983 [DK] Denmark ..... 3759/83

[51] Int. Cl.[4] ..... B65D 85/20; B65D 67/02

[52] U.S. Cl. ..... 206/234; 206/38; 206/86; 7/151; 81/3.15; 81/3.36

[58] Field of Search ..... 7/151; 30/400, 410; 81/3.09, 3.15, 3.29, 3.36, 3.57; 206/37, 38, 86, 216, 234

[56] References Cited

U.S. PATENT DOCUMENTS

| | | | |
|---|---|---|---|
| 2,208,478 | 7/1940 | Simons et al. | 81/3.09 |
| 2,828,855 | 4/1958 | Mosch | 206/234 |
| 4,361,920 | 12/1982 | Zanni | 7/151 |
| 4,373,223 | 2/1983 | Miller | 81/3.09 |

FOREIGN PATENT DOCUMENTS

| | | | |
|---|---|---|---|
| 0719945 | 10/1965 | Canada | 81/3.15 |

*Primary Examiner*—William Price
*Assistant Examiner*—Jimmy G. Foster
*Attorney, Agent, or Firm*—Fitch, Even, Tabin & Flannery

[57] ABSTRACT

A case preferably for a lighter (3), especially of the disposable type, is tubular and at its lower end it comprises a recess (4*a*, 4*b*, 5*a*, 5*b*), which partly is provided with a gripping part (8) projecting radially inwards and gripping under the free rim (11) of a cap (10) so as to loosen said cap from a bottleneck (12), and partly comprises a counter-holding part (5*a*, 5*b*) opposing the gripping part (8) and abutting and pressing on the top side of a cap (10). The case is made of a single sheet member (1) of metal, especially steel. The case (1) is bent substantially symmetrically from the longitudinal central line of the sheet member (1) so as to form two opposing side walls (26, 27), of which the first side wall is continued, whereas the second side wall (27) formed by the outer portion of the sheet member (1) is broken. The rims of the outer portions maintain a narrow slot therebetween, whereby the lighter (3) is retained by the resilience of the metal. The recess (4*a*, 4*b*, 5*a*, 5*b*) extends obliquely from the lower rim of the case (1) on the continued first side wall (26) when the lighter (3) is completely inserted and further upwards to the second side wall (27) while the recess (4*a*, 4*b*, 5*a*, 5*b*) covers the body of the lighter (3) over a length corresponding, when seen in the longitudinal direction, to the distance between the gripping part (8) and the counter-holding part (5*a*, 5*b*), said distance being necessary for the gripping part (8) to grip the cap (10). As a result the total length of the case with a completely inserted lighter therein may be relatively small.

6 Claims, 10 Drawing Figures

CASE PREFERABLY FOR A LIGHTER

TECHNICAL FIELD

The invention relates to a case preferably for a lighter especially of the disposable type, and which retains the lighter through friction, said case being tubular with an opening at its upper end and at its lower end comprising a recess, which partly is provided with a gripping part projecting radially inwards and gripping under the free rim of a cap so as to loosen said cap from a bottleneck, and partly comprises a counter-holding part opposing the gripping part and cooperating with said gripping part and further abutting and pressing on the top side of a cap.

BACKGROUND ART

Danish divulgated Patent Application No. 4157/81 discloses a case for a lighter, preferably a disposable lighter, and of the type stated above, said case being made of plastics and provided with a bottom wall. The gripping part comprises a separate part of band iron secured by means of barbs in a guideway inside the case, whereas the counter-holding part is formed by a recess on the underside of the bottom wall. The bottom wall comprises a planar top side forming a stop for the bottom of the lighter inserted in the case. As the bottle opener formed by the gripping part and the counter-holding part is positioned below the bottom wall, i.e. outside the channel-shaped room defined by the side and bottom walls of the case and containing the lighter, the total length of the lighter case with a completely inserted lighter therein is relatively great compared to the length of the lighter alone. As a result, the lighter case with a lighter inserted therein is rather large to carry in the pocket, a bag or the like carrying place. Furthermore the gripping part projecting freely and radially into the recess and made of band iron may tear the lining of a pocket or bag during transport, or the user may get scratched thereon when he puts his hand in the pocket or the bag. In addition, the gripping part has a tendency to work loose from the case when said case is used for removing tight-fitting caps.

DISCLOSURE OF INVENTION

The object of the present invention is to provide a case with a bottle opener of the type mentioned above, which permits the total length of the case with a completely inserted lighter therein to be relatively small.

The case according to the invention is characterised in that the case is made of a single sheet member of metal, especially steel, that the case is bent substantially symmetrically from the longitudinal central line of the sheet member so as to form two opposing side walls, of which the first side wall is continuous, whereas the second side wall formed by the outer portions of the sheet member is broken, the rims of the outer portions maintaining a narrow slot therebetween, whereby the lighter is retained by the resilience of the metal, and that the recess extends obliquely from the lower rim of the case on the when the continuous first side wall when the lighter is completely inserted, the gripping part being formed at said lower rim of the case, and further upwards to the second side wall while the recess covers the body of the lighter over a length corresponding, when seen in the longitudinal direction, to the distance between the gripping part and the counter-holding part, said distance being necessary for the gripping part to grip the cap. As a result, the channel-shaped room formed by the side walls of the case and receiving a lighter extends to the lower rim of the case on the continued first side wall, and both the gripping part and the counter-holding part are positioned at the bottom inside said room, the latter two parts forming a cap remover. When the lighter is to be used for removing a cap, it is pushed a short distance out of the case, said distance corresponding to the height of the recess. Upon use the lighter is inserted into the case again. The movement in- and outwards of the case of the lighter is easy to carry out since the case retains the lighter through a clamping effect by means of a slot between the rims of the second side wall and the resilience of the sheet metal used. The pushing of the lighter into the case upon use implies that the bottom of the lighter is carried to the lower rim of the case in such a manner that the total length of the case with lighter corresponds practically to the length of the lighter alone.

As the bottom surface of the lighter abuts the gripping part projecting radially inwards after insertion into the case, said gripping part cannot tear for instance the lining of a trouser pocket during transport, and the user will not get scratched by the gripping part.

As the gripping part is formed integral with the sheet member, it is furthermore achieved that the gripping part is permanently fixed without a tendency to work loose.

As the sheet member used is made of metal, it is furthermore possible to mark names and similar data on the case.

According to the invention, the sheet member may comprise an end portion projecting outwards at the bottom and in the middle of the unfolded case, said end portion being defined by two inclined side rims and a substantially circular lower free rim. As a result, the recess in the lower end of the case is of a shape substantially corresponding to the outer inclined surfaces on the rim of a cap, and furthermore the free rim on the gripping part of the projecting end portion corresponds almost to the radius of curvature of the bottleneck provided with the cap.

Moreover according to the invention, the gripping part may be formed by an inwardly bent lower rim portion on the lower rim of the continued first side wall, whereby said gripping part also forms a stop for the bottom of the lighter inserted in the case.

In addition according to the invention, the case may in at least one transverse direction be of an inner cross-sectional dimension which is smaller than the corresponding outer cross-sectional dimension of the lighter insertable in the case in such a manner that a tight fit is provided between the case and the lighter. In this manner a reliable retaining of the lighter in the case is obtained.

Furthermore according to the invention, the case may in the upper rim comprise a substantially U-shaped recess. As a result, the gas adjusting disc of the lighter is freely accessible when the lighter is inserted in the case, so that it is possible merely by one finger to adjust the gas adjusting disc without having to push the lighter a distance out of the case.

Finally according to the invention, the continued first side wall may at the bottom comprise a hole with a cutting edge on the inner side of the side wall. In this manner an additional advantage is obtained, namely that the case can be used for cigar-cutting as well as for clamping the tip cut off of the cigar. The latter is permitted by initially pulling the lighter a short distance out of the case, subsequently inserting the tip of the cigar into the hole, and subsequently putting the lighter back into the case, whereby the bottom of the lighter presses the tip of the cigar towards the cutting edge of the hole so as to cut off said tip. When the lighter subsequently is inserted completely in the case, the cigar tip cut off is clamped between the bottom of the lighter and the gripping part of the case, said gripping part being formed by the bent lower rim portion of the projecting end portion of the case. In this manner the cigar tip does not unintendedly fall on the floor upon the cutting.

BRIEF DESCRIPTION OF DRAWING

The invention will be described below with reference to the accompanying drawing, in which.

BEST MODE FOR CARRYING OUT THE INVENTION

Figure 2:
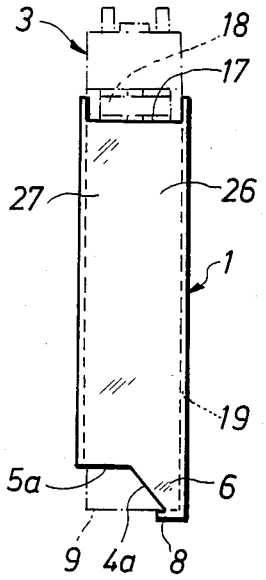
FIG. 2 is a side view of the case with the lighter of FIG. 1.
Figure 3:
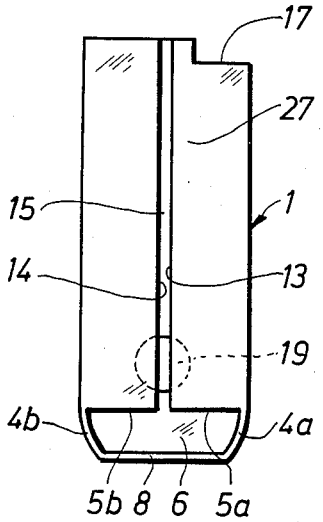
FIG. 3 is a rear view of the case of FIG. 1 without the lighter.
Figure 4:
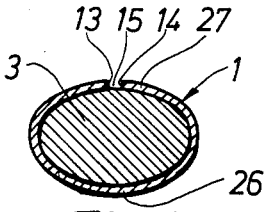
FIG. 4 is a horizontal cross-sectional view through the case and the lighter taken along the line IV—IV of FIG. 1.
Figure 5:
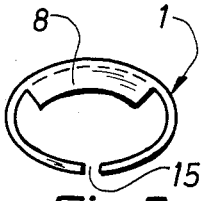
FIG. 5 is a bottom end view of the case of FIG. 1.

The case 1 illustrated in FIGS. 1–5 is formed as a tube open at both ends and with two opposing side walls 26 and 27, cf. FIG. 4. This case 1 defines a channel for a lighter 3, especially a disposable lighter, in such a manner that the upper end of said lighter 3 projects outside the case 1 so as to be lit without problems.

Figure 1:
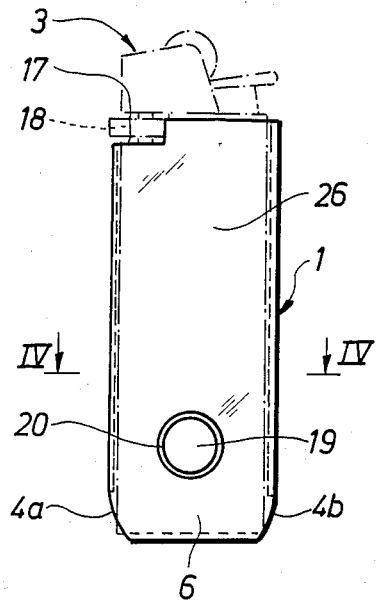
FIG. 1 is a front view of an embodiment of a case according to the invention, a lighter being indicated through a dotted line in the case.
Figure 6:
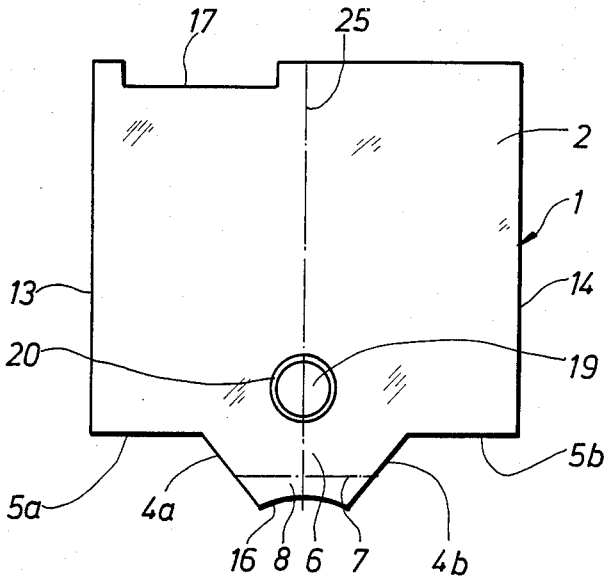
FIG. 6 illustrates an unfolded sheet member for the manufacture of the case.

As illustrated in FIG. 6, the case is made of a single sheet member 1 of metal, especially steel. The case is bent substantially symmetrically from the longitudinal central line 25 of the sheet member 1 so as to form the two side walls 26 and 27. The first side wall 26, cf. FIGS. 1 and 4, is continuous whereas the second side wall 27, cf. FIGS. 3 and 4, is formed by the outer portions of the sheet member 1 and is broken, the rims 13 and 14 of the outer portions forming a slot 15 therebetween allowing the case 1 to retain lighters of varying cross-sectional dimensions through the resilience of the metal.

At the lower end, the case 1 is provided with a recess 4*a*, 4*b*, 5*a*, 5*b*, cf. FIGS. 2, 3, and 6. This recess is partly provided with a gripping part 8 projecting radially inwards and gripping under the free rim 11, cf. FIG. 7, of a cap 10 so as to loosen said cap 10 from a bottleneck 12, and partly comprises a substantially transverse bottom rim 5*a*, 5*b* on the broken second side wall 27 of the case 1, said rim opposing the gripping part 8. This bottom rim 5*a*, 5*b* forms a counter-holding part abutting and pressing on the top side of a cap 10. The recess 4*a*, 4*b*, 5*a*, 5*b* extends obliquely from the lower rim of the continued first side wall 26 of the case 1 when the lighter 3 is completely inserted, the gripping part 8 being formed at said lower rim. The recess extends further upwards to the second side wall 27 in such a manner that when seen in the longitudinal direction, it covers the body of the lighter 3 over a length corresponding to the distance between the gripping part 8 and the counter-holding part 5*a*, 5*b*, which allows the gripping part 8 to grip the cap 10. In this manner a case with a lighter is obtained, whereby the total length of the case with a completely inserted lighter 3 is relatively small, i.e. substantially equal to the length of the lighter 3.

As illustrated in FIG. 6, the unfolded sheet member 1 comprises at the bottom and in the middle a projecting end portion 6 defined by the two inclined side rims 4*a*, 4*b* and a substantially circular lower rim 16. The two inclined side rims 4*a*, 4*b* imply that the recess 4*a*, 4*b*, 5*a*, 5*b* in the lower end of the case is of a shape substantially corresponding to the outer inclined surfaces of the rim 11 of a cap 10, cf. FIG. 7. The substantially circular, lower free rim 16 of the gripping part 8 of the projecting end portion 6 corresponds almost to the radius of curvature of the bottleneck 12 provided with the cap 10. The end portion 6 comprises a lower, transverse bending line 7 indicated by a dotted line, the gripping part 8 being bent about said line 7.

The gripping part 8 is formed by an inwardly bent lower rim portion 8 on the lower rim of the continued first side wall 26. As a result, a gripping part 8 is obtained which forms a stop for the bottom of the lighter 3 inserted in the case 1.

As the case with the gripping part 8 and the counter-holding part 5*a*, 5*b* is made of a single sheet member 1, cf. FIG. 6, of metal, a simple and sturdy construction of a case is obtained. This case may serve partly to receive a lighter 3 and partly to remove bottle caps 10. In addition a simple manufacture of the case is obtained, since the case for instance may be manufactured by a planar member 1, cf. FIG. 6, initially being punched out of a metal plate in one operation, and subsequently said plate member is bent or deformed in another manner to form a tube of the desired cross-sectional shape, whereafter the rim part 8 of the projecting end portion 6 of the case is bent and butted to form a gripping part.

As it appears from FIG. 4, the case 1 is of an inner cross-sectional dimension in at least one transverse direction, which is smaller than the corresponding outer cross-sectional dimension of the lighter 3 insertable in the case 1 in such a manner that a tight fitting between the case 1 and the lighter 3 is obtained. As a result, a reliable retaining of the lighter 3 in the case 1 is obtained.

Figure 7:
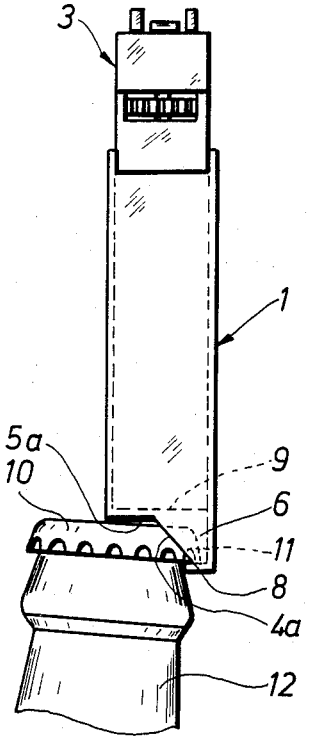
FIG. 7 illustrates a case situated on top of a cap on a bottleneck, the gripping part of the case being engaged so as to remove the cap, and the lighter being slightly pulled out.

FIG. 7 illustrates how the case 1 can be used as a bottle opener. The case 1 is situated on top of a cap 10 on a bottleneck 12, and the lighter 3 is slightly pulled out of the case 1 so as to give way for the cap 10. By pulling the lighter 3 slightly out of the case 1, a greater lever arm moment is furthermore obtained. The gripping part 8 of the case grips under the free rim 11 of the cap 10, while the counter-holding part 5*a*, 5*b* of the case abuts and presses on the top side of the cap 10. By using the case 1 as a handle member and by pressing the case downwards to the left in one turning movement, the cap 10 is gradually loosened from the bottleneck 12. When the cap 10 is removed, the lighter 3 is pushed into its position in the case 1. The recess 4*a*, 4*b*, 5*a*, 5*b* is preferably of a height corresponding almost to the height of a cap 10.

As illustrated in FIGS. 1, 2, 3, and 6, the case 1 comprises in its upper rim a substantially U-shaped recess 17. In this manner the gas adjusting disc 18 of the lighter is freely accessible in the recess 17 when said lighter 3 is inserted in the case 1. In this manner it is possible to adjust the gas adjusting disc 18 by means of a finger as desire arises without necessitating a removal of the lighter 3 from the case 1.

Figure 8:
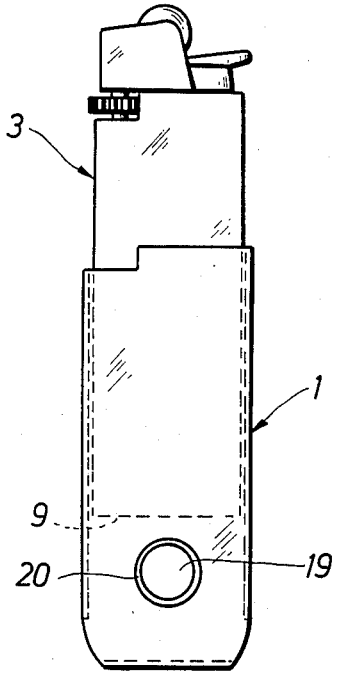
FIG. 8 illustrates the case with the lighter in a position where said lighter is pulled out a greater distance than FIG. 1 and such that the case and the lighter can be used as a cigar cutter.

In the continuous first side wall 26, the case 1 may be formed with a hole 19 with a cutting edge 20 on the inner side of said side wall 26. This hole 19 is for cutting cigar tips. As a result, the case 1 may be used as a cigar cutter in addition to the use as a lighter case and a bottle opener. The cigar cutting is carried out in the following manner: initially the lighter 3 is pushed a short distance out of the case 1 into the position illustrated in FIG. 8, in which the bottom 9 of the lighter is positioned above the hole 19. Subsequently, the tip of the cigar is inserted into the hole 19 whereafter the bottom 9 of the lighter is moved past the hole 19 in such a manner that the tip of the cigar is pressed against the cutting edge 20 of the hole 19 and cut off. When the lighter 3 is subsequently completely inserted in the case, it is furthermore obtained that the cigar tip cut off is clamped between the bottom 9 of the lighter 3 and the gripping part 8 of the case in such a manner that the cigar tip does not unintendedly fall on the floor.

The hole 19 in the case 1 is preferably situated at the bottom adjacent the projecting end portion 6. In this manner the lighter 3 need only be pulled out a short distance from the case 1 when said case 1 is to be used as a cigar cutter. At the same time a better guide of the lighter 3 in the case 1 is obtained during the cutting operation.

Figure 9:
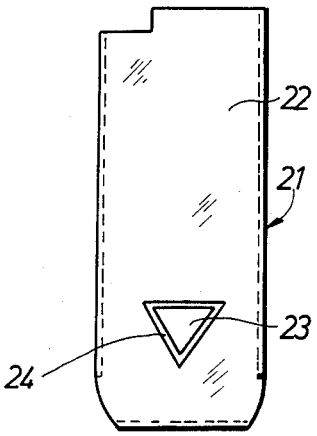
FIG. 9 is a front view of a second embodiment of a case according to the invention.
Figure 10:
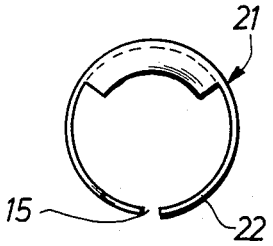
FIG. 10 is a bottom end view of the case of FIG. 9.

FIGS. 9 and 10 illustrate a second embodiment of a case 21, which like the case 1 of FIG. 1 may be used as a lighter case, a bottle opener, and a cigar cutter. The case 21 separates from the case 1 of FIG. 1 by the wall 22 of the case being shaped in such a manner that it is of a circular cross section, cf. FIG. 10. Thus the case 21 may receive lighters of a circular cross section unlike the lighter 3 of FIG. 1 being of an oval cross section. Furthermore, the case 21 is provided with a triangular hole 23 at the bottom and not with a circular hole 19 as the case 1 of FIG. 1. The case 21 comprises a slot corresponding to the slot 15 of FIG. 3.

Besides, the case may be amended in many ways without thereby deviating from the scope of the invention. The recess 17 at the top of the rim of the case may for instance be omitted. In addition to an oval or a circular cross section, the case may be of an arbitrary suitable cross-sectional shape in response to the lighters to be inserted therein.

The case is made of metal, especially steel, on account of the high tensile strength of these materials. Stainless steel is particularly suited in order to avoid formation of rust. The surface of the case may be nickeled, chromium-plated, painted or surface-treated in another manner, if necessary. When using steel, a material of a thickness of 0.50–1.00 mm is suitable.

A width of 1–2 mm of the slot 15 between the longitudinal rims 13 and 14 of the case is preferred. The rims 13 and 14 may, however, be permanently interconnected as illustrated in FIGS. 9 and 10.

The case according to the invention may also be used for other articles beyond the lighter, e.g. for a little electric torch.

I claim:

1. A case for frictionally retaining a lighter,
said case being tubular and having an opening at its upper end and a lower rim at its lower end;
the lower rim having means to form an obliquely extending recess for receiving a portion of a bottle cap, the lower rim further having means to form an inwardly projecting gripping part for engaging the bottle cap from below and a counter-holding part opposing the gripping part for abutting and pressing on the bottle cap from above to cooperate with the gripping part in loosening the cap from a bottle;
the case being made of a single sheet metal member bent substantially symmetrically from a longitudinal central line to form first and second opposing side walls;
the first side wall being continuous;
the second side wall being broken by a slot defined by edge portions of said sheet metal member to provide resilience for retaining the lighter;
said recess receiving a portion of said lighter when said lighter is fully inserted into the case.

2. A case in accordance with claim 1 wherein, in its unfolded configuration, the sheet metal member includes a downwardly projecting lower portion defined by two inclined rim portions and a substantially circular rim portion.

3. A case in accordance with claim 1 wherein the gripping part is on the continuous first side wall.

4. A case in accordance with claim 1 wherein the case has an inner cross-sectional dimension smaller than a corresponding outer cross-sectional dimension of the lighter so as to provide a tight fit.

5. A case in accordance with claim 1 wherein the opening at the upper end is defined by an upper rim having a substantially U-shaped recess therein.

6. A case in accordance with claim 1 wherein the first side wall includes a hole defined by a cutting edge.

* * * * *